US007896728B2

(12) United States Patent
Schwartz et al.

(10) Patent No.: US 7,896,728 B2
(45) Date of Patent: Mar. 1, 2011

(54) MACHINING METHODS USING SUPERABRASIVE TOOL

(75) Inventors: Brian J. Schwartz, West Hartford, CT (US); Daniel F. Grady, Athens (GR); Robert E. Erickson, Storrs, CT (US)

(73) Assignee: United Technologies Corporation, Hartford, CT (US)

( * ) Notice: Subject to any disclaimer, the term of this patent is extended or adjusted under 35 U.S.C. 154(b) by 603 days.

(21) Appl. No.: 11/854,847

(22) Filed: Sep. 13, 2007

(65) Prior Publication Data

US 2009/0075564 A1 Mar. 19, 2009

(51) Int. Cl.
*B24B 1/00* (2006.01)

(52) U.S. Cl. ..... 451/53; 451/48; 451/58; 451/913

(58) Field of Classification Search ..... 452/47, 452/48, 53, 58, 913
See application file for complete search history.

(56) References Cited

U.S. PATENT DOCUMENTS 5,203,122 A * 4/1993 Campbell ..... 451/53
7,007,382 B2 * 3/2006 Mantel ..... 29/889.2
7,101,263 B2 9/2006 Schwartz et al.
7,144,307 B2 12/2006 Schwartz et al.
7,303,461 B1 * 12/2007 Campomanes et al. ..... 451/28
2006/0035566 A1 2/2006 Grady et al.

FOREIGN PATENT DOCUMENTS

EP 1500453 A1 1/2005

OTHER PUBLICATIONS

European Search Report for EP Patent Application No. 08252937.1 dated May 10, 2010.

* cited by examiner

*Primary Examiner*—Timothy V Eley
(74) *Attorney, Agent, or Firm*—Bachman & LaPointe, P.C.

(57) ABSTRACT

A tool for use in an abrasive machining process has a body extending along a central longitudinal axis from a first end to a tip end. An abrasive material is located on the tip end. The body has a tip end protuberance. An abrasive material is located on the protuberance. A body lateral surface has, over a radial span of at least 20% of a radius of the protuberance, a continuously concave longitudinal profile diverging tipward.

15 Claims, 4 Drawing Sheets

MACHINING METHODS USING SUPERABRASIVE TOOL

BACKGROUND

The disclosure relates to machining. More particularly, the disclosure relates to superabrasive machining of metal alloy articles Superabrasive quills for point and flank superabrasive machining (SAM) of turbomachine components are respectively shown in commonly-owned U.S. Pat. Nos. 7,101,263 and 7,144,307. Commonly-owned U.S. Pat. Publication 2006-0035566 discloses a quill having a tip protuberance.

SUMMARY

One aspect of the disclosure involves a tool for use in an abrasive machining process. A body extends along a central longitudinal axis from a first end to a tip end. The body has a tip end protuberance. An abrasive material is located on the protuberance. A body lateral surface has, over a radial span of at least 20% of a radius of the protuberance, a continuously concave longitudinal profile diverging tipward.

In various implementations, the radial span may be at least 30% of said radius. The abrasive material may be along at least half of the radial span. The body may include a threaded portion for engaging a machine, a flange having a pair of flats for receiving a wrench, and a shaft extending tipward from the flange. The abrasive material may comprise a coating. The abrasive material may be selected from the group consisting of plated cubic boron nitride, vitrified cubic boron nitride, diamond, silicon carbide, and aluminum oxide. The tool may be combined with a machine rotating the tool about the longitudinal axis at a speed in excess of 10,000 revolutions per minute.

Another aspect of the invention involves a process for point abrasive machining of a workpiece. A tool is provided having a tip protuberance grinding surface coated with an abrasive. The tool is oriented relative to a surface of the workpiece so that there is contact between the surface and the grinding surface. A part is formed by removing material at the contact by rotating the tool about the central longitudinal axis and translating the tool relative to the workpiece and off-parallel to the longitudinal axis. The tool is cooled by guiding a cooling liquid flow to the tip grinding surface along a surface of the shaft and radially diverging to the grinding surface.

In various implementations, the tool may be rotated at a speed in the range of 40,000 to 120,000 revolutions per minute. The longitudinal axis may be reoriented relative to the workpiece while machining the workpiece. The workpiece may comprise an integrally bladed disk. The workpiece may comprise or may consist essentially of a nickel- or cobalt-based superalloy or titanium alloy.

The details of one or more embodiments are set forth in the accompanying drawings and the description below. Other features, objects, and advantages will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
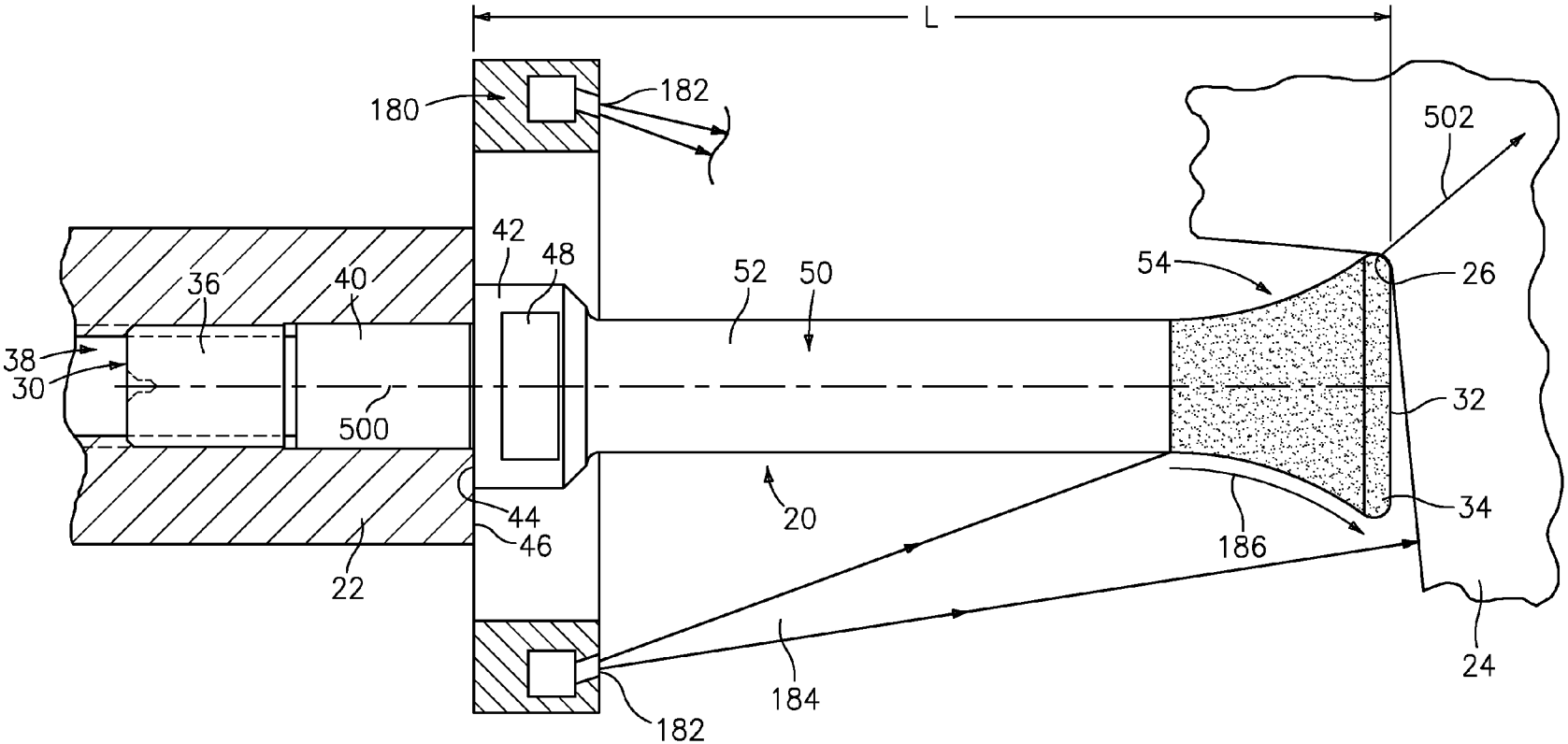
FIG. 1 is a side view of a quill according to principles of the invention.

FIG. 1 shows an abrasive quill 20 mounted in a multi-axis machine tool spindle 22. The machine tool rotates the quill about a central longitudinal axis 500 and translates the quill in one or more directions (e.g., a direction of translation 502) to machine a workpiece 24. Exemplary rotation is at a speed in excess of 10,000 rpm (e.g., in the range of 40,000 rpm-140,000 rpm). The traversal of the quill removes material and leaves a cut surface 26 on the workpiece. The machine tool may further reorient the axis 500. Alternatively or additionally, the machine tool may reposition or reorient the workpiece. The exemplary quill 20 includes a metallic body extending from an aft end 30 to a front (tip) end 32 (e.g., at a flat face). An abrasive coating 34 on the tip end provides cutting effectiveness.

Near the aft end 30, the exemplary quill includes an externally threaded portion 36 for mating by threaded engagement to a correspondingly internally threaded portion of a central aperture 38 of the spindle 22. Ahead of the threaded portion 36, an unthreaded cylindrical portion 40 fits with close tolerance to a corresponding unthreaded portion of the aperture 38 to maintain precise commonality of the quill/spindle/rotation axis 500. A wrenching flange 42 is forward (tipward) of the unthreaded portion 40 and has a radially-extending aft surface 44 abutting a fore surface 46 of the spindle. The exemplary flange 42 has at least a pair of parallel opposite wrench flats 48 for installing and removing the quill via the threaded engagement. Alternatively, features other than the threaded shaft and wrenching flange may be provided for use with tools having different quill interfaces such as are used with automatic tool changers.

A shaft 50 extends generally forward from the flange 42 to the tip 32. In the exemplary embodiment, the shaft 50 includes a proximal portion 52 and a horn-like tip protuberance portion 54.

In the exemplary embodiment, the proximal portion 52 is relatively longer than the protuberance 54. The tip protuberance 54 is sized to make the required cut features. If a relatively smaller diameter protuberance is required, the shaft may be stepped (e.g., as in US Pat. Publication 2006-0035566, the disclosure of which is incorporated by reference in its entirety herein as if set forth at length). The length of the proximal portion 52 (combined with the length of the protuberance) provides the desired separation of the tip from the tool spindle. Such separation may be required to make the desired cut while avoiding interference between the spindle and any portion of the part that might otherwise interfere with the spindle.

Figure 2:
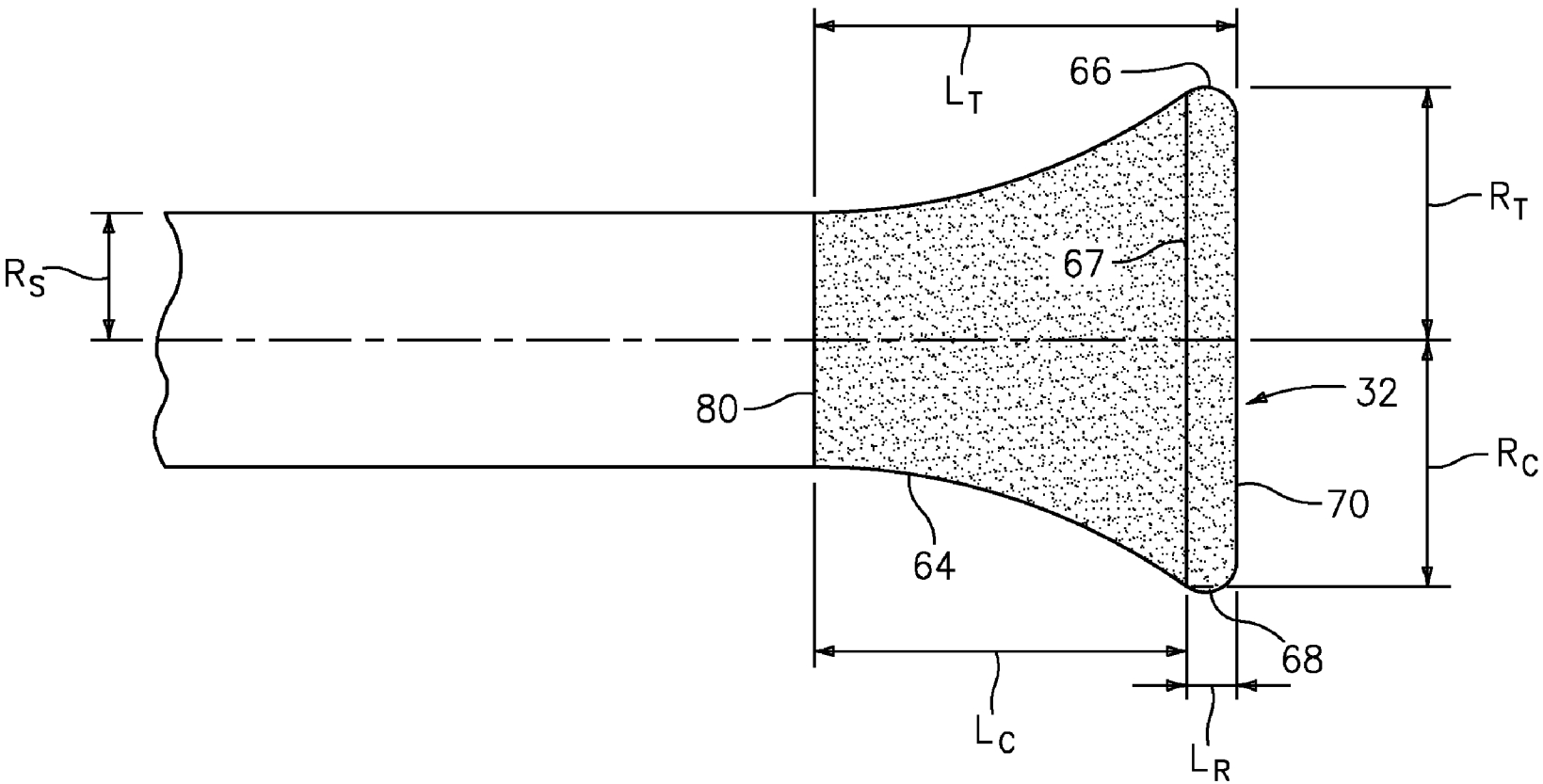
FIG. 2 is an enlarged view of a tip area of the quill of FIG. 1.

In longitudinal section, the surface of the protuberance 54 (FIG. 2) has a concave transition 64 to the adjacent straight portion of the shaft (e.g., the proximal portion 52). A convex portion 66 extends forward thereof from a junction/inflection 67 through an outboardmost location 68 and back radially inward to form the end 32. The exemplary quill has a flat end face 70. As is discussed further below, the exemplary protuberance has an abrasive coating at least along the convex portion 66. An exemplary coating, however, extends proximally beyond the junction 67 (e.g., along the entirety of the protuberance) and along the end face 70.

Alternative implementations may, for example, include a central recess in the end so as to leave a longitudinal rim. The presence of the recess eliminates the low speed contact region otherwise present at the center of the tip. This permits a traversal direction 502 at an angle θ close to 90° off the longitudinal/rotational axis 500.

The exemplary transition 64 radially diverges from a junction 80 with the adjacent straight portion of the shaft (e.g., the proximal portion 52). At this exemplary junction, the shaft and transition have a radius $R_S$. Along the transition 64, the radius progressively increases toward the end 32. The tip has a largest radius $R_T$. The divergence of the transition 64 may provide a structural reinforcement. For example, with $R_T$ larger than $R_S$, and no transition, the protuberance would be formed as a disk at the end of the shaft. The disk would have a tendency to flex/wobble during use. The transition braces against such flex/wobble.

The transition 64 may also help direct coolant and/or lubricant to the contact area between the quill and the workpiece (the grinding zone). For example, FIG. 1 shows a tool-mounted nozzle 180 having a circumferential array of coolant outlets 182 circumscribing the quill. Each of the outlets discharges a stream 184. The streams impact along the transition 64 and are guided by the transition to form a tipward flow 186 along the transition to the grinding zone.

An exemplary transition 64 is concave in longitudinal section. This may provide an advantageous combination of strength, light weight, and guidance of the coolant flow.

The exemplary protuberance has a length $L_T$ from the junction 80 to the end 32. Of this length, the convex or radial rim portion 66 has a length $L_R$. The exemplary concave transition 64 has a length $L_C$. A radius at the junction 67 is $R_C$. Exemplary $R_C$ is at least 80% of $R_T$, more narrowly, 90%, or 95%. An exemplary change in radius over the transition ($R_C$ minus $R_S$) is at least 20% of $R_T$, more narrowly, at least 30% (e.g., 30-60%). Exemplary $L_T$ and $L_C$ are larger than $R_S$, more narrowly, at least 150% of $R_S$ (e.g., 200-500%).

Figure 3:
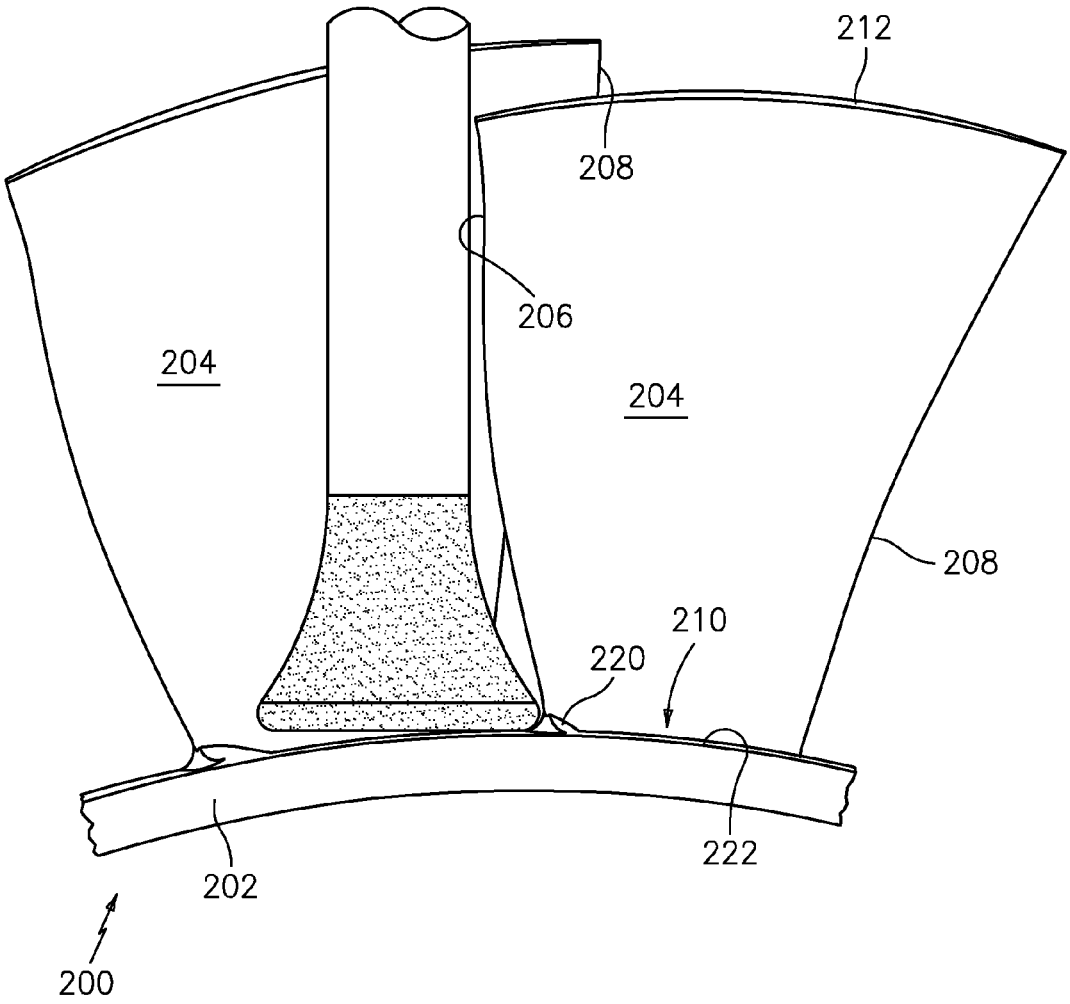
FIG. 3 is a view of the quill of FIG. 1 machining an integrally bladed rotor.

FIG. 3 shows exemplary positioning of the quill 20 during one stage of the machining of an integrally bladed rotor 200 (IBR, also known as a blisk). The unitarily-formed blisk 200 has a hub 202 from which a circumferential array of blades 204 radially extend. Each blade has a leading edge 206, a trailing edge 208, a root 210 at the hub, and a free tip 212. Each blade also has a generally concave pressure side and generally concave suction side extending between the leading and trailing edges. In the exemplary blisk 200, a fillet 220 is formed between the outer surface 222 (defining an inter-blade floor) of the hub and the blades. The quill 20 is shown grinding a leading portion of a blade suction side and fillet near the interblade floor. The divergence of the protuberance allows access around the curve of the blade span. The same or a different quill may be used to machine surface contours (e.g., pressure side concavity and suction side convexity) of the blades. A traversal at or near normal to the quill axis may permit machining of the floor 222.

Figure 4:
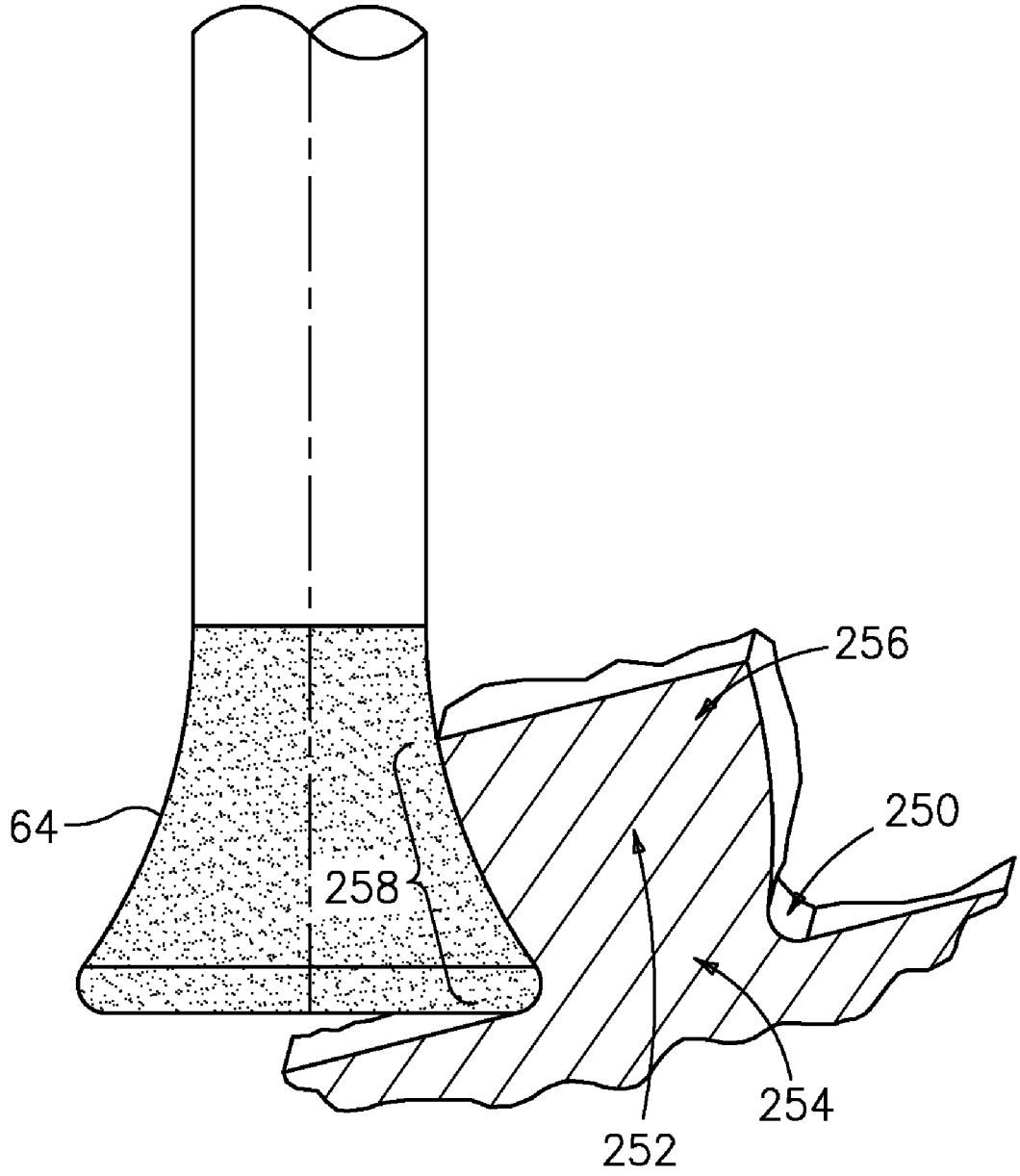
FIG. 4 is a view of the quill of FIG. 1 machining an undercut.

Other situations involve machining undercuts. Various examples of undercuts are used for backlocked attachment of one component to another and/or for lightening purposes. In various such undercut situations, during one or more passes of the quill, the grinding zone may extend up along the concave transition 64. For example, FIG. 4 shows machining to leave undercuts 250 on each side of a rail 252. Along the undercuts, a base/root/proximal portion 254 of the rail is recessed relative to a more distal portion 256. Such recessing on both sides renders the proximal portion narrower than the distal portion (e.g., with a thickness at a minima being at least 10% less (e.g., (20-50%)than a thickness at a maxima). The exemplary grinding zone 258 extends (at least for the pass/traversal being illustrated) partially along the concave transition 64 (e.g., along slightly more than half the longitudinal length of the transition). An exemplary rail 252 serves as a structural reinforcement rib on a gas turbine engine augmentor case segment (e.g., as part of an ISOGRID rib structure (e.g., three groups of intersecting ribs along the inner diameter (ID) or outer diameter (OD) of the case segment). In such a situation, the undercuts may serve to lighten the case with a relatively low reduction in strength. Such undercuts may also provide attachment locations (e.g. for a clamp or other joining member to grasp the rail). In a reengineering situation they may replace baseline non-undercut ribs or may replace baseline undercut ribs formed by chemical milling/etching (thereby reducing chemical waste, contaminations, and/or other hazards). The protuberance permits the undercutting of a geometry that a straight tool (e.g., of similar length and of diameter corresponding either to $R_S$ or $R_T$) would not have access to cut (e.g., a T-like rail/rib).

Another optional feature is elongate recesses (e.g., as in U.S. Pat. Publication 2006-0035566), which may serve to help evacuate grinding debris.

In an exemplary manufacturing process, the basic quill body is machined (e.g., via one or more lathe turning steps or grinding steps) from steel stock, including cutting the threads on the portion 36. There may be heat and/or mechanical surface treatment steps. The abrasive may then be applied as a coating (e.g., via electroplating). Exemplary superabrasive material may be selected from the group of cubic boron nitride (e.g., plated or vitrified), diamond (particularly useful for machining titanium alloys), silicon carbide, and aluminum oxide. The exemplary superabrasive material may have a grit size in the range of 40/45 to 325/400 depending on the depth of the cut and the required surface finish (e.g., 10 μin or finer). A mask may be applied prior to said coating and removed thereafter to protect areas where coating is not desired. For example, the mask may confine the coating to the tip protuberance portion 54. Particularly for a vitrified coating, the as-applied coating may be dressed to improve machining precision. To remanufacture the quill, additional coating may be applied (e.g., optionally after a removal of some or all remaining used/worn/contaminated coating).

An exemplary projecting length L of the quill forward of the spindle is 57 mm, more broadly, in a range of 40-80 mm. An exemplary protuberance radius $R_T$ is 10 mm, more broadly 8-20 mm. An exemplary longitudinal radius of curvature of the convex portion is 1-3 mm, more broadly 0.5-4 mm.

One or more embodiments have been described. Nevertheless, it will be understood that various modifications may be made. Accordingly, other embodiments are within the scope of the following claims.

What is claimed is:

1. A process for point abrasive machining of a workpiece comprising the steps of:

providing a tool having:

a shaft having a central longitudinal axis;

a tip protuberance grinding surface coated with an abrasive, the tool having a lateral surface having, over a radial span of at least 20% of the radius of the tip protuberance, a continuously concave longitudinal profile diverging tipward;

orienting said tool relative to a surface of said workpiece to be machined so that there is contact between said surface to be machined and said grinding surface; and forming a part by removing material at said contact by:

rotating said tool about the central longitudinal axis;

translating the tool relative to the workpiece and off-parallel to the longitudinal axis while machining the workpiece; and cooling the tool by guiding a cooling liquid flow to the grinding surface, the cooling flow being guided along a surface of the shaft and radially diverging to the grinding surface.

2. The process of claim 1 wherein said rotating step comprises rotating said tool at a speed in the range of 40,000 to 140,000 revolutions per minute.

3. The process of claim 1 further comprising reorienting the longitudinal axis relative to the workpiece while machining the workpiece.

4. The process of claim 1 wherein:

the workpiece comprises a gas turbine engine case segment; and the machining forms a structural rib having a proximal portion narrower than a base portion.

5. The process of claim 1 wherein:

the workpiece comprises an integrally bladed disk; and the machining forms a fillet at a blade inboard end.

6. The process of claim 1 wherein the workpiece consists essentially of titanium alloy.

7. The process of claim 1 wherein the workpiece comprises a nickel- or cobalt-based superalloy.

8. The process of claim 1 wherein the workpiece consists essentially of a nickel- or cobalt-based superalloy.

9. The process of claim 1 wherein the translating is off normal to the longitudinal axis.

10. The process of claim 1 wherein:

the shaft has a portion having a smaller diameter than a diameter of the tip protuberance; and during the machining, the smaller diameter of the shaft portion relative to the tip protuberance is effective to avoid interference between the tool and the workpiece.

11. The method of claim 1 wherein:

the continuously concave longitudinal profile extends along a length larger than a radius of the shaft proximally thereof.

12. The method of claim 11 wherein:

the length is 200-500% of the radius.

13. A process for point abrasive machining of an engine case segment comprising the steps of:

providing a tool having:

a shaft having a central longitudinal axis;

a tip protuberance grinding surface coated with an abrasive, the tool having a lateral surface having, over a radial span of at least 20% of the radius of the tip protuberance, a continuously concave longitudinal profile diverging tipward;

orienting said tool relative to a surface of said workpiece to be machined so that there is contact between said surface to be machined and said grinding surface; and forming a part by removing material at said contact by:

rotating said tool about the central longitudinal axis;

translating the tool relative to the workpiece and off-parallel to the longitudinal axis while machining the workpiece so that the protuberance machines an undercut defining a proximal portion of a structural rib in a grid of ribs along a surface of the segment, the proximal portion being narrower than a distal portion.

14. The method of claim 13 wherein:

the continuously concave longitudinal profile extends along a length larger than a radius of the shaft proximally thereof.

15. The method of claim 14 wherein:

the length is 200-500% of the radius.

* * * * *